US005176016A

United States Patent [19]

Hill

[11] Patent Number: 5,176,016

[45] Date of Patent: Jan. 5, 1993

[54] AUTOMOBILE HANDLE GUARD PLATE

[76] Inventor: Mark L. Hill, P.O. Box 228, Tucson, Ariz. 85702

[21] Appl. No.: 854,335

[22] Filed: Mar. 19, 1992

[51] Int. Cl.[5] ..... E05B 15/16

[52] U.S. Cl. ..... 70/417; 70/452

[58] Field of Search ..... 70/416-418, 70/448, 452

[56] References Cited

U.S. PATENT DOCUMENTS

| | | | |
|---|---|---|---|
| 1,484,831 | 2/1924 | Hurd | 70/417 |
| 3,083,563 | 4/1963 | Greenwald | 70/417 |
| 3,645,045 | 2/1972 | Gervis et al. | 70/417 |
| 4,041,741 | 8/1977 | Cintron | 70/417 |
| 4,074,552 | 2/1978 | Smith | 70/417 |
| 4,139,999 | 2/1979 | Allenbaugh | 70/452 |
| 4,160,368 | 7/1979 | Solow | 70/417 |
| 4,466,264 | 8/1984 | del Nero | 70/417 |
| 4,530,223 | 7/1985 | Oliver | 70/417 |
| 4,619,123 | 10/1986 | Hill | 70/417 |
| 4,765,165 | 8/1988 | O'Gara | 70/417 |

FOREIGN PATENT DOCUMENTS

| | | | |
|---|---|---|---|
| 2641568 | 7/1990 | France | 70/417 |
| 1236574 | 6/1971 | United Kingdom | 70/452 |

*Primary Examiner*—Renee S. Luebke
*Assistant Examiner*—Suzanne L. Dino
*Attorney, Agent, or Firm*—Ogram & Teplitz

[57] ABSTRACT

An improved automobile handle guard plate assembly which provides added strength via a lipped brace which overlays and strengthens a security plate. The security plate and the brace are secured together with an adhesive and positioned between the exterior door handle and the automobile's door. The door handle is permitted easy access to the locking mechanism within the door via an opening in the security plate. A thief trying to enter the automobile by accessing the locking mechanism through the door, finds a security plate to prevent access and a brace on the security plate to preventing deformation of the security plate.

17 Claims, 2 Drawing Sheets

AUTOMOBILE HANDLE GUARD PLATE

BACKGROUND OF THE INVENTION

Theft of automobiles is on the rise and the easiest place for a thief to gain access to a locking mechanism is through the lock cylinder. Typically an automobile's door or trunk has an opening which is used to contain the activator mechanism/lock cylinder to the lock mechanism inside the door or trunk. The activator mechanism, by necessity, requires a hole in the door or trunk. Through this hole, a pry bar such as a screwdriver, is inserted and the interior locking mechanism is accessed.

Recognition of this weakness in the security of an automobile has been around for many years; numerous devices have been developed which attempt to cure this deficiency.

One such device is described in U.S. Pat. No. 4,160,368, entitled "Automobile Trunk Lock Guard" issued to Solow on Jul. 10, 1979. This device provides a security plate which surrounds the lock cylinder. The plate is secured to the vehicle through the use of metal screws.

The use of metal screws requires added complexity in the installation process and also is not aesthetically pleasing. Additionally, the apparatus is unsuitable for a handle situation since the added plate's thickness disrupts the dimensional requirements for the handle to reach the interior locking mechanism.

Another attempt to provide additional security is described in U.S. Pat. No. 4,530,223, entitled "Guard For Key Cylinder" issued to Oliver on Jul. 23, 1985. This apparatus is a metal plate which bolts around the outside surface to protect the key cylinder. Again, the use of bolts are required and the plate is inoperative with a factory built handle.

In both of these situation, strength for the security plate is accomplished by expanding the thickness of the generally flat plate. This additional thickness prevents a thief from buckling or deforming the security plate; but, the added thickness also requires the use of a replacement handle as the factory installed handle is no longer able to reach the door's locking mechanism properly.

Recognizing that the less disruptive a device is to the existing automobile, the more likely the device is to be used, U.S. Pat. No. 4,619,123, entitled "Guard Plate and Method for Automobile Door Handle" issued to Hill on Oct. 28, 1986, was developed.

The Hill apparatus utilizes the existing door handle and places a security plate between the handle and the automobile door. No drilling or exterior screws were needed and all of the existing parts on the automobile still interact with each other.

In certain situations though, the Hill security plate, being substantially a flat metal plate, could be bent or deformed by an aggressive thief and thereby permit access to the interior locking mechanism.

It is clear that there is a need for additional security at the activator mechanism.

SUMMARY OF THE INVENTION

The invention is an improved automobile handle guard plate assembly which provides added strength via a lipped brace which overlays and strengthens a security plate. The security plate and the brace are secured together with an adhesive and positioned between the exterior door handle and the automobile's door. The door handle is permitted easy access to the locking mechanism within the door via an opening in the security plate.

A thief trying to enter the automobile by accessing the locking mechanism through the door, finds a security plate to prevent access and a brace on the security plate preventing the deformation of the security plate.

The assembly consists of three basic parts. The first part is a security member such as that described in U.S. Pat. No. 4,619,123, entitled "Guard Plate and Method for Automobile Door Handle" issued to Hill on Oct. 28, 1986, incorporated hereinto by reference. Those of ordinary skill in the art readily recognize various other security plates which will also serve this function. This security member is generally a flat piece of metal having protective tags or flanges.

The second part of the assembly is a brace member which is intended to overlay the security member. Around the peripheral of the brace member, a lip is formed so as to mimic certain contours of the security member.

This lip, being at an angle, typically ninety degrees, to the plane of the brace member, provides additional structural strength for the final assembly.

The third part of the assembly is an adhesive which is used to affix the security member to the brace member into one assembly which operates in the same manner as described in U.S. Pat. No. 4,619,123.

In the preferred embodiment, a pair of sealing members are attached to the security device on th handle to plate surface and the plate to automobile body surface. These sealing members provide weather proofing once the assembly is attached to the automobile's door.

Preferrably, the width of the lip on the brace member is chosen to be less than the combined depth of the security member and the sealing member. In this manner, a proper seal is obtained since the lip from the brace member does not press against the automobile's door.

The invention together with various embodiments thereof, will be more fully described by the following drawings and their accompanying descriptions.

DRAWINGS IN BRIEF

DRAWINGS IN DETAIL

Figure 1A:
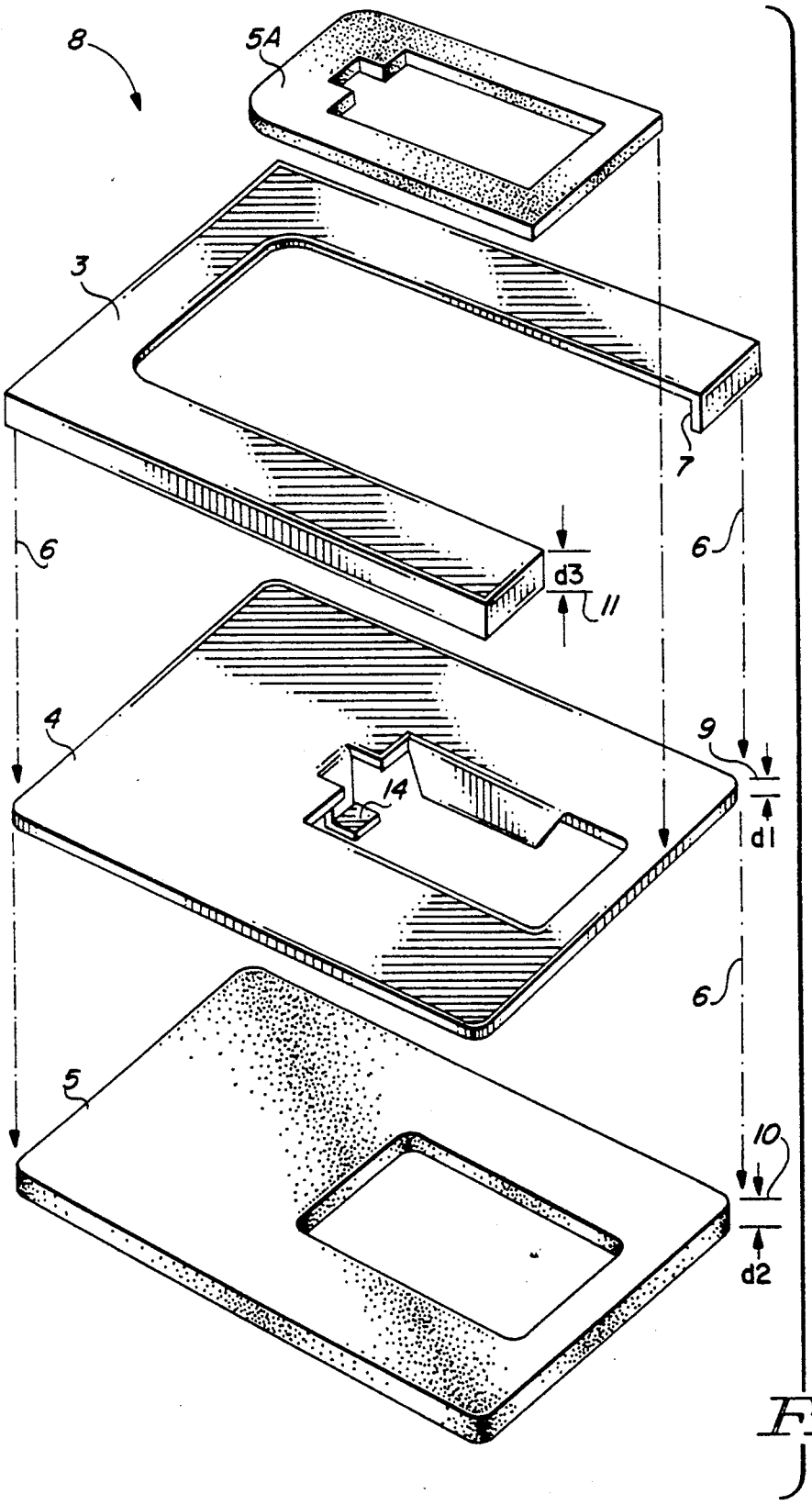
FIG. 1A is an exploded view of an embodiment of the invention illustrating the inter-relationship between the different members.

FIG. 1A is an exploded view of an embodiment of the invention illustrating the inter-relationship between the different members.

Security member 4 is of the type described before. Security member 4 is a substantially flat stock have a depth d1, 9. Flange 14 extends downward to enter the car door (not shown) and provide additional security from pry bars or the like.

Brace member 3 is structured such that when it is placed over security member 4, lip 7 of brace member 3 matches selected contours of security member 4. Note that lip 7 does not have to entirely encircle security member 4 but is placed to provide additional support where needed.

In this embodiment, brace member 3 is "U" shaped to provide added structural support around the edges indicated. Those of ordinary skill in he art readily recognize other shapes which will supply the proper structural integrity.

Lip 7 has a length d3, 11. It is lip 7 and its right angle relationship to the body of brace member 3 that provide the mechanical rigidity sought.

In the basic embodiment, brace member 3 is adhered to security member 4, as shown by arrows 6, via an epoxy or other such adhesion means (not shown).

In one embodiment of the invention, a sealant member 5 is adhered to security member 4 so as to provide a weather seal once the entire assemblage is placed on the automobile's door. Sealant member 5 has a depth d2, 10. A second optional sealing member 5A is also used to seal between the handle (not shown) and the security member 4.

Figure 1B:
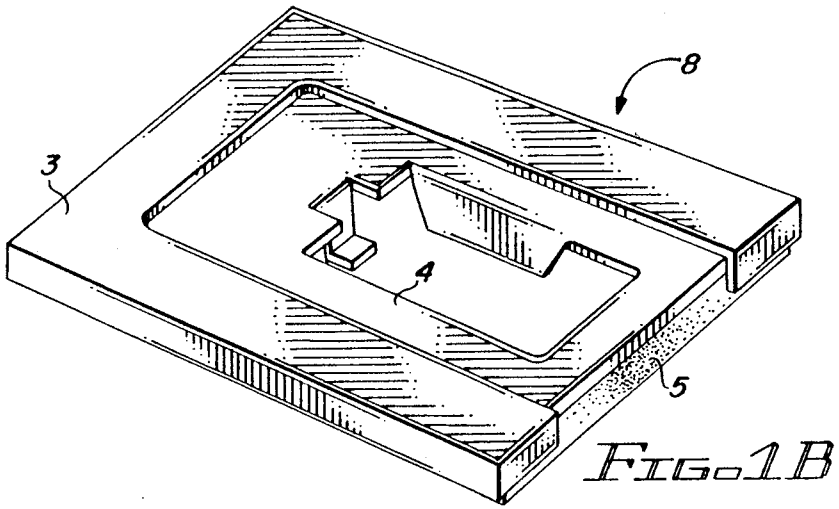
FIG. 1B is a perspective view of the embodiment of the assembled members from FIG. 1A.

FIG. 1B is a perspective view of the embodiment of the assembled members from FIG. 1A.

In this embodiment, security member 3 is sandwiched between brace member 3 and sealant member 5. Note that the length of lip 7 is less than the combined depth of security member 4 and sealant member 5 (i.e. $d3<d1+d2$) which permits proper sealing of the handle guard plate 8 to the automobile door (not shown).

Also note that in this embodiment, brace member 3 does not completely cover security member 3. The opening through brace member 4 permits the automobile handle (not shown) to contact and press against security member 3. This permits the factory handle to reach the inner lock within the door without any modification.

Figure 2:
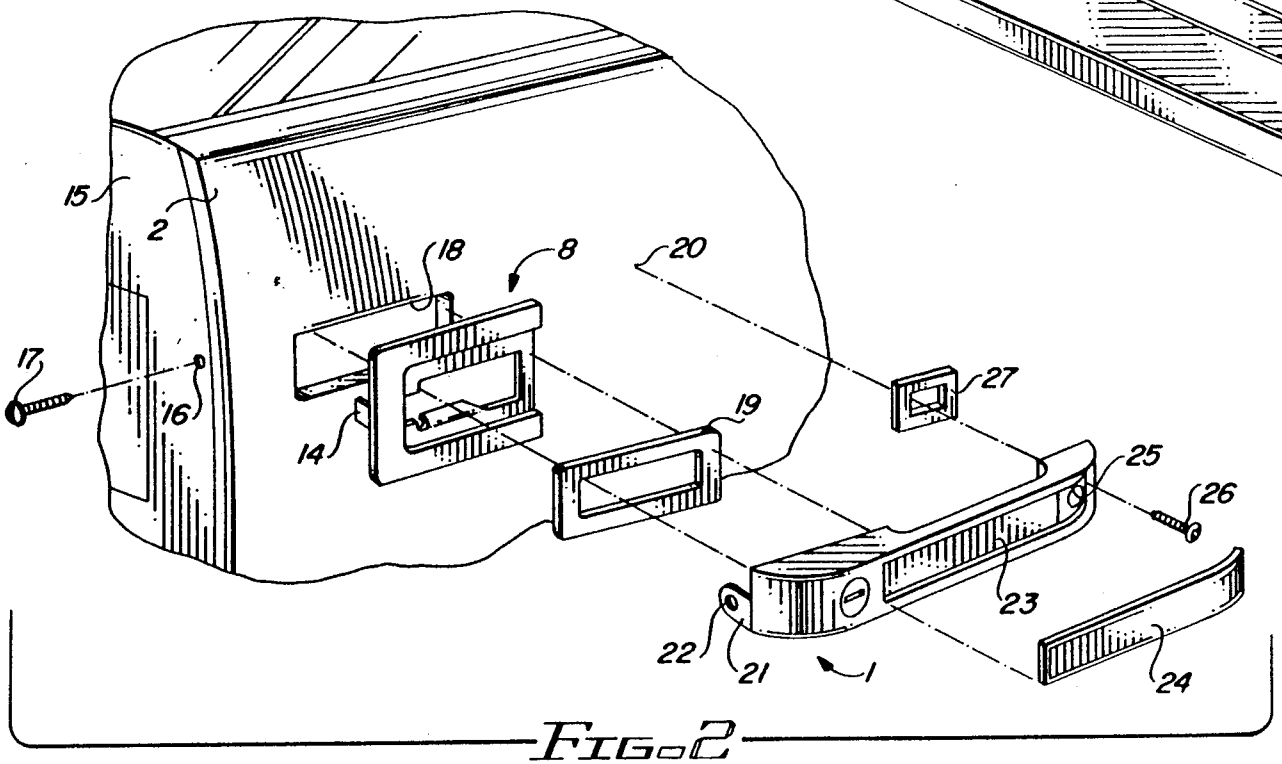
FIG. 2 is a perspective view of an embodiment of the invention as applied to an automobile's door and handle.

FIG. 2 is a perspective view of an embodiment of the invention as applied to an automobile's door and handle.

The method of installation in the preferred embodiment, involves first unlocking door 2 and opening it to expose screw 17 that is accessible by an ordinary screwdriver. This screw 17, together with a second screw 26 secure the handle to the door. Second screw 26 is concealed by a piece of removable trim 24 in recess 23 in the outer surface of handle mechanism 1. Second screw 26 extends through hole 25 in the front end of handle, through a bezel 27, and into a threaded hole 20 in the surface of door panel 2.

After screws 17 and 26 have been removed, handle mechanism 1 is removed. A bezel 19, having a rectangular opening therein through which the inner operative portion of handle mechanism 1 extends, is provided on a variety of automobiles including the Volkswagen Rabbit model. This bezel or gasket is reusable depending on the thickness of the plate 9. The guard plate 10 is inserted into opening 18 so that tab 14 and protective flanges extend into the interior of door 2 through door panel opening 18.

Alternatively, the inner operative part of the handle mechanism is inserted through opening 10 of guard plate 8 first, so that clearance hole 14 in tab 13 is aligned with threaded hole 22 in tongue member 1. Then both guard plate 8 and handle mechanism 1 are simultaneously inserted through opening 18 in door panel 2, aligning clearance hole 16 in the end plate of the door with both clearance hold 14 and threaded hole 22. If desired, bezel 19 is reused or a thinner bezel or no bezel at all is used.

Installation is completed by rethreading screw 17 through clearance hole 16, clearance hole 14, and into threaded hole 22 of tongue member 21 and tightening it. Bezel 27 is positioned and screw 26 is tightened into threaded hole 20. The piece of trim 24 is reinserted into recess 23.

In this manner, an improved automobile handle guard in installed which discourages thefts of the vehicle or its contents.

What is claimed is:

1. An improved guard plate assembly for use on an automobile door having an exterior handle mechanism operating, through an opening in said automobile door, a locking mechanism inside the automobile door, said improved guard plate assembly comprising:

a) a rigid guard plate having an aperture therein and having an integral first and second flange extending inwardly from opposed upper and lower edges of the aperture into the opening in said automobile door, said rigid guard plate structured to be imposed between said exterior handle mechanism and said automobile door such that attachment of said exterior handle mechanism to said door affixes said rigid guard plate therebetween, said rigid guard plate having a substantially uniform thickness;

b) a brace member having a lip portion structured to mimic selected contours of said rigid guard plate, said lip portion having a depth less than the thickness of said rigid guard plate; and, c) adhesion means for securing said rigid guard plate to said brace member.

2. The improved guard plate assembly according to claim 1 wherein said brace member is shaped to permit the exterior handle mechanism to contact a portion of said rigid guard plate.

3. The improved guard plate assembly according to claim 2 wherein said brace member is structured to avoid contacting said exterior handle mechanism.

4. The improved guard plate assembly according to claim 3 further including a sealant member attached to a peripheral portion of said rigid guard plate, said sealant member positioned on an opposite side of said rigid guard plate from said brace member.

5. An improved guard plate assembly for use on an automobile door having an exterior handle mechanism operating, through an opening in said automobile door, a locking mechanism inside the automobile door, said improved guard plate assembly comprising:

a) a rigid guard plate having an aperture therein and having an integral first and second flange extending inwardly from opposed upper and lower edges of the aperture into the opening in said automobile door, said rigid guard plate structured to be imposed between said exterior handle mechanism and said automobile door such that attachment of said exterior handle mechanism to said door affixes said rigid guard plate therebetween, said rigid guard plate having a substantially uniform thickness;

b) a sealant member attached to a peripheral portion of said rigid guard plate;

c) a brace member having a lip portion structured to mimic selected contours of said rigid guard plate, the lip portion of said brace member having a depth less than the combined thickness of said substantially uniform thickness of said rigid guard plate and said sealant member; and, d) adhesion means for securing said rigid guard plate to said brace member.

6. An improved guard plate assembly for use on an automobile door having an exterior handle mechanism operating a locking mechanism inside the automobile door, said improved guard plate assembly comprising:

a) a security member structured to be imposed between said exterior handle mechanism and said automobile door such that portions of said security member provide security from unauthorized access to said locking mechanism, said security member having a substantially uniform thickness;

b) a brace member having a lip portion having a predetermined width and which mimics selected contours of said security member; and, c) adhesion means for securing said security member to said brace member.

7. The improved guard plate assembly according to claim 6 wherein said brace assembly is shaped to permit the exterior handle mechanism to contact a portion of said security member.

8. The improved guard plate assembly according to claim 7 wherein said security member includes tabs for insertion into said automobile door.

9. The improved guard plate assembly according claim 8 wherein said security member includes an orifice structured to permit a portion of said exterior handle mechanism to extend into said door and contact said locking mechanism.

10. The improved guard plate assembly according to claim 9 wherein said brace member is structured to avoid contacting said exterior handle mechanism.

11. The improved guard plate assembly according to claim 10 further including a sealant member attached to a peripheral portion of said security member, said sealant member positioned on an opposite side of said security member from said brace member.

12. The improved guard plate assembly according to claim 11 wherein the width of said lip portion of said brace member has a width less than the combined thickness of said substantially uniform thickness of said security assembly and said sealant member.

13. An improved automobile door assembly comprising:

a) an automobile door;

b) a locking mechanism located interior to said automobile door;

c) an exterior handle mechanism operating, through an opening in said automobile door, the locking mechanism inside the automobile door;

d) a rigid guard plate having an aperture therein and having an integral first and second flange extending inwardly from opposed upper and lower edges of the aperture into the opening in said automobile door, said rigid guard plate structured to be imposed between said exterior handle mechanism and said automobile door such that attachment of said exterior handle mechanism to said door affixes said rigid guard plate therebetween, said rigid guard plate having a substantially uniform thickness;

e) a brace member having a lip portion structured to mimic selected contours of said rigid guard plate, said lip portion having a depth less than the thickness of said rigid guard plate; and, f) adhesion means for securing said rigid guard plate to said brace member.

14. The improved automobile door assembly according to claim 13 wherein said brace member is shaped to permit the exterior handle mechanism to contact a portion of said rigid guard plate.

15. The improved automobile door assembly according to claim 14 wherein said brace member is structured to avoid contacting said exterior handle mechanism.

16. The improved automobile door assembly according to claim 15 further including a sealant member attached to a peripheral portion of said rigid guard plate, said sealant member positioned on an opposite side of said rigid guard plate from said brace member.

17. An improved automobile door assembly comprising:

a) an automobile door;

b) a locking mechanism located interior to said automobile door;

c) an exterior handle mechanism operating, through an opning in said automobile door, the locking mechanism inside the automobile door;

d) a rigid guard plate having an aperture therein and having an integral first and second flange extending inwardly from opposed upper and lower edges of the aperture into the opening in said automobile door, said rigid guard plate structured to be imposed between said exterior handle mechanism and said automobile door such that attachment of said exterior handle mechanism to said door affixes said rigid guard plate therebetween, said rigid guard plate having a substantially uniform thickness;

e) a sealant member attached to a peripheral portion of said rigid guard plate;

f) a brace member having a lip portion structured to mimic selected contours of said rigid guard plate, the lip portion of said brace member having a depth less than the combined thickness of said substantially uniform thickness of said rigid guard plate and said sealant member; and, g) adhesion means for securing said rigid guard plate to said brace member.

* * * * *